US008406942B2

(12) United States Patent
Siddappa et al.

(10) Patent No.: US 8,406,942 B2
(45) Date of Patent: Mar. 26, 2013

(54) CONTROL OF THROTTLE AND BRAKING ACTIONS AT INDIVIDUAL DISTRIBUTED POWER LOCOMOTIVES IN A RAILROAD TRAIN

(75) Inventors: Chandrashekar Siddappa, Orlando, FL (US); Robert Moffitt, Palm Bay, FL (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/530,436

(22) Filed: Jun. 22, 2012

(65) Prior Publication Data

US 2012/0259488 A1 Oct. 11, 2012

Related U.S. Application Data

(62) Division of application No. 12/404,280, filed on Mar. 14, 2009, now Pat. No. 8,239,078.

(51) Int. Cl.
*G05D 1/00* (2006.01)
*H04B 1/02* (2006.01)

(52) U.S. Cl. ..... 701/19; 455/92

(58) Field of Classification Search ..... 701/2, 19, 701/20; 105/62.1; 455/92
See application file for complete search history.

(56) References Cited

U.S. PATENT DOCUMENTS

2003/0036368 A1* 2/2003 Higgs ..... 455/92
2003/0040853 A1* 2/2003 Brousseau et al. ..... 701/19

* cited by examiner

*Primary Examiner* — James Trammell
*Assistant Examiner* — Muhammad Shafi
(74) *Attorney, Agent, or Firm* — GE Global Patent Operation; John A. Kramer

(57) ABSTRACT

A method for controlling first and second locomotives of a railroad train, the first and the second locomotives separated by at least one railcar. The method comprises determining a location of the first locomotive and a location of the second locomotive, determining an operating condition of the first locomotive and an operating condition of the second locomotive, determining a first control aspect of the first locomotive responsive to the operating condition and the location of the first locomotive, determining a second control aspect of the second locomotive responsive to the operating condition and the location of the second locomotive, and controlling the first and the second locomotives according to the first control aspect and the second control aspect, respectively.

21 Claims, 6 Drawing Sheets

CONTROL OF THROTTLE AND BRAKING ACTIONS AT INDIVIDUAL DISTRIBUTED POWER LOCOMOTIVES IN A RAILROAD TRAIN

CROSS-REFERENCE TO RELATED APPLICATIONS

This application is a divisional application of U.S. patent application Ser. No. 12/404,280, which was filed on 14, Mar. 2009 now U.S. Pat. No. 8,239,078, and is incorporated by reference in its entirety.

TECHNICAL FIELD

The subject matter disclosed herein relates to a railroad train control system for use with a distributed power train comprising a lead locomotive and one or more remote locomotives.

BACKGROUND

Under operator control, a railroad locomotive supplies motive power (traction) to move a train and applies brakes on the locomotive and/or on train railcars to slow or stop the train. The motive power is supplied by electric traction motors responsive to an AC or DC voltage generated by the locomotive engine.

The railroad train comprises three separate brake systems. An air brake system comprises a fluid-carrying brake pipe that extends a length of the train and connects to each rail car. An operator in the lead locomotive controls the fluid pressure in the brake pipe and each rail car responds to the sensed pressure. At each rail car, car brakes are applied responsive to a decrease in the sensed fluid pressure and released responsive to a pressure increase. Each locomotive also comprises an independent pneumatic brake system, coupled to the air brake system, controlled by the operator to apply or release the locomotive brakes.

Each locomotive is also equipped with a dynamic brake system. Activation of the dynamic brakes reconfigures the traction motors of the locomotive to operate as generators, with the locomotive wheels supplying rotational energy to turn the generator rotor winding. Magnetic forces developed by generator action within the traction motors resist wheel rotation and thus create wheel-braking forces. The energy produced by the generator action is dissipated as heat in a resistor grid in the locomotive and removed from the grid by cooling blowers. Use of the dynamic brakes is indicated to slow the train when application of the locomotive independent brakes and/or the railcar air brakes may cause the locomotive or railcar wheels to overheat or when their prolonged use may cause excessive wheel wear. The dynamic brakes may be applied, for example, when the train is traversing a prolonged downgrade. Recently, the Federal Railway Administration mandated a dynamic brake monitor that provides an operator in a lead locomotive of a distributed power train (described below) with the status of the dynamic brakes at each remote locomotive.

A distributed power railroad train comprises a lead locomotive at a head end of the train and one or more remote locomotives in the train consist. A remote locomotive applies power or braking actions (referred to as distributed power/braking) responsive to commands issued by the lead locomotive operator over a distributed power control and communications system. The distributed power (DP) communications system further comprises a communications channel (e.g., a radio frequency (RF) communications channel or a wire-based communications channel) linking the lead and the remote locomotives.

A DP controller generates traction and brake commands responsive to operator-initiated (where the operator is located in the lead locomotive) control of a lead locomotive traction controller (or throttle handle) or a lead locomotive brake controller. The traction or brake commands are transmitted to the remote locomotives over the communications channel. The receiving remote locomotives respond to traction or brake commands to apply tractive effort or to apply or release the brakes. The receiving remote locomotives advise the lead locomotive that the command was received and executed. For example, when the lead locomotive operator operates the lead locomotive throttle controller to apply tractive effort at the lead locomotive (the tractive effort based on a selected throttle notch number) the DP system commands each remote locomotive to apply the same tractive effort (the same notch number) and each remote locomotive replies acknowledging execution of the command. The lead locomotive also monitors remote locomotive status through remote-issued status messages. The lead and remote locomotives can also issue alarm messages.

In general, traction and braking messages sent over the distributed power communications system result in the application of more uniform tractive and braking forces to the railcars, as each locomotive can effect a brake application or brake release at the speed of the communications channel. Distributed power train operation may therefore be preferable for long train consists to improve train handling, especially throttle and dynamic braking applications, and performance. Trains operating over mountainous terrain can realize benefits from DP operation.

The DP control and communications system can be configured in various operational modes that control interactions between the lead and the remote locomotives and execution of lead locomotive commands at the remote locomotives. Two such modes are referred to as synchronous control mode and independent (e.g., front locomotive group/back locomotive group) control mode. In synchronous control all remote locomotives follow the throttle and dynamic brake setting of the lead locomotive. For example, if the lead locomotive operator moves the lead locomotive throttle handle from a notch five position to a notch seven position, the DP system commands each remote locomotive to change to a notch seven throttle position. If the operator moves the throttle handle to a dynamic brake position the DP communications system commands each remote locomotive to the same dynamic brake application.

Typically, the operator configures the locomotives to front group/back group operation to provide better train control when significant terrain gradients are encountered. According to this operational mode, all locomotives assigned to the front group are controlled as the lead locomotive is controlled. The locomotives of the back group also are all identically controlled according to a back group command entered by the lead operator and transmitted to each back group locomotive, which command may differ from the front group command.

In front group/back group or independent control mode the lead locomotive operator assigns each remote locomotive to either a front group or aback group of locomotives, separated by a "fence." The assignments are dynamically controllable by the operator so that locomotives can be reassigned from the front group to the back group, and vice versa, while the train is operating. Such reassignments can optimize train control. The lead locomotive operator commands each locomotive to front group operation or back group operation by issuing a command over the DP communications system or over an interconnecting conductor.

The remote locomotives assigned to the front group follow the throttle and dynamic brake handle positions of the lead locomotive according to messages sent over the DP communications system. The back group remote locomotives are controlled independently of the front group, but all back group locomotives are identically controlled. The operator operates the DP controller in the lead locomotive to create and transmit a control signal to the back group locomotives. The control signal places each of the back group locomotives in traction or braking operation and further specifies the magnitude (or percentage) of the traction or braking to be applied.

Long distributed power trains are often difficult to control when cresting hills (transitioning from steep uphill to steep downhill grades). As the lead locomotive crests the hill, the train tends to accelerate as an increasing number of cars are on the downhill grade versus the uphill grade. If the train accelerates significantly when stretched over the crest, the operator can lose control of the train, creating a destructively hazardous situation.

When the train is in synchronous mode, if the operator applies the railcar and/or the independent locomotive brakes while one or more remote locomotives and a significant number of railcars are on the uphill side of the crest, these locomotives and railcars may create excessive braking forces for locomotives and railcars farther toward the rear of the train. Also, the locomotives and cars on the downhill grade continue to provide large pull forces, as the applied braking forces have substantially less effect on the downhill grade. This situation can result in the train breaking apart, an obvious and destructive hazard.

To avoid these potentially dangerous situations, the front group/back group independent operational mode can be used, for example, when the train is traversing a mountain. As the train climbs the mountain, the lead locomotive and all remote locomotives provide maximum motive power. When the lead locomotive tops the crest it alone is assigned to the front group, the remaining locomotives are assigned to the back group. The operator controls the from group lead locomotive to apply dynamic brakes or throttle down, while the back group locomotives continue to apply tractive effort to pull the train over the mountain. As a first remote locomotive tops the crest, it is reassigned from the back group to the front group. The first remote automatically follows the dynamic brake application or throttles down to match operation of the lead locomotive. The remaining remote locomotives (e.g., in the back group) continue to apply tractive effort according to the throttle setting of the back group. The process of operator reassignment of the remote locomotives from the back group to the front group continues until the last remote locomotive tops the crest and is reassigned to the front group for application of its dynamic brakes.

Although the DP system includes interlocks to prevent the application of forces that may pull the train apart as locomotives are reassigned from the back to the front group, effective operator control of this scenario can be difficult. Effective operator control depends on the skill level of the operator and many trains break apart due to improper operator control. Operator control may be further complicated by unfamiliar train make-up, travel over unknown terrain, etc.

BRIEF DESCRIPTION

One embodiment of the inventive subject matter comprises a method for controlling first and second locomotives of a railroad train, the first and the second locomotives separated by at least one railcar. The method comprises determining a location of the first locomotive and a location of the second locomotive, determining an operating condition of the first locomotive and an operating condition of the second locomotive, determining a first control aspect of the first locomotive responsive to the operating condition and the location of the first locomotive, determining a second control aspect of the second locomotive responsive to the operating condition and the location of the second locomotive, and controlling the first and the second locomotives according to the first control aspect and the second control aspect, respectively.

The operating condition of the first and the second locomotives comprises, for example, a gradient of the rails on which the train is traveling, condition of the rails, terrain, time of day, speed restrictions (as posted for a specific rail segment or according to a condition of the train locomotives), emissions, fuel consumption, weather conditions, axle load, the condition of the DP system, and locomotive or railcar conditions. The control aspect of the first and second locomotive comprises a specific traction, dynamic braking or air braking action or operation.

This embodiment of the inventive subject matter can solve one or more problems associated with railroad train control by automatically determining a control aspect of the train according to the location of the train and one or more operating conditions.

BRIEF DESCRIPTION OF DRAWINGS

The embodiments of the presently described inventive subject matter can be more easily understood and the further advantages and uses thereof more readily apparent, when considered in view of the following detailed description when read in conjunction with the following figures, wherein.

In accordance with common practice, the various described features are not drawn to scale, but are drawn to emphasize specific features relevant to the embodiments of the inventive subject matter. Reference characters denote like elements throughout the figures and text.

DETAILED DESCRIPTION

Figure 1:
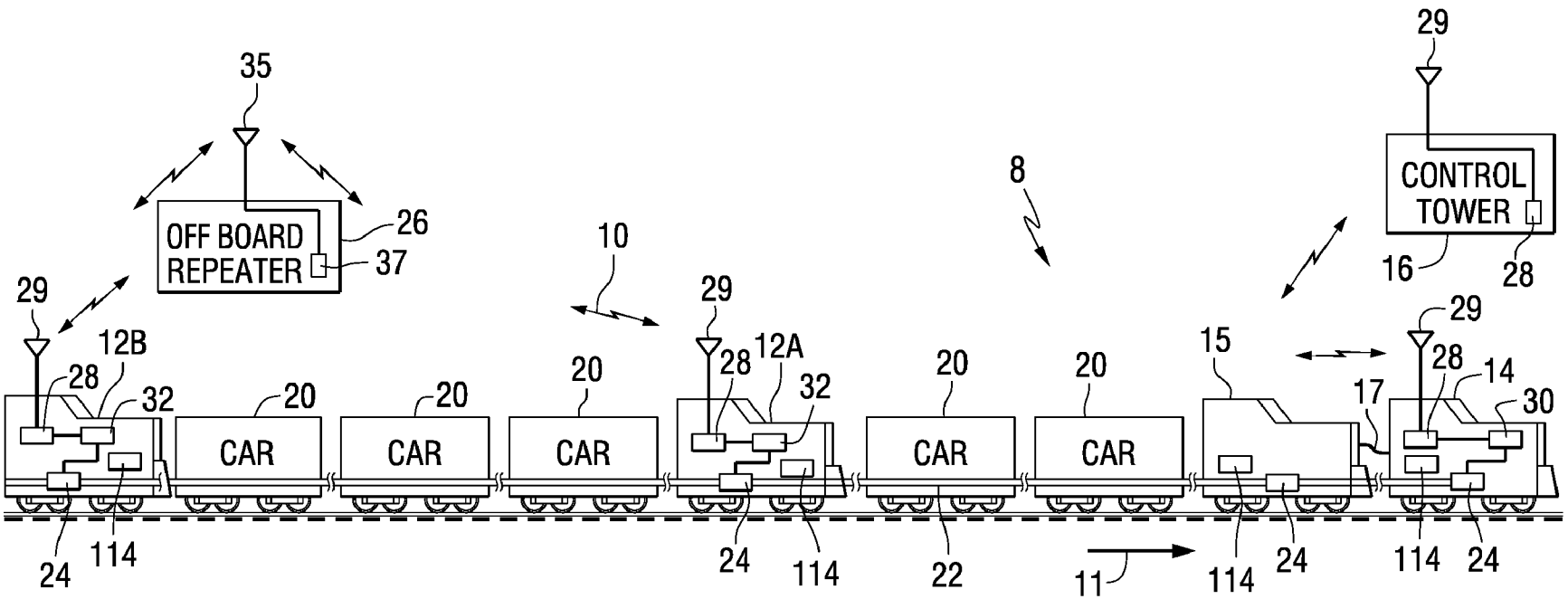
FIG. 1 is a schematic illustration of a distributed power train to which the teachings of the embodiments of the presently described inventive subject matter can be applied.

Before describing in detail the methods and apparatuses in accordance with the embodiments of the presently described inventive subject matter, it should be observed that the inventive nature of the various embodiments resides primarily in a novel combination of hardware and software elements related to the methods and apparatuses. Accordingly, the hardware and software elements have been represented by conventional elements in the drawings, showing only those specific details that are pertinent to the embodiments of the inventive subject matter, so as not to obscure the disclosure with structural details that will be readily apparent to one of ordinary skill in the art having the benefit of the description herein. All singular nouns are intended to include the plural form of the noun and vice versa.

The following embodiments are not intended to define limits as to the structures or methods of the inventive subject matter, but only to provide exemplary constructions. The embodiments are permissive rather than mandatory and illustrative rather than exhaustive.

One example of a radio-based train control and communications systems (DP system) is the LOCOTROL® distributed power communications system available from the General Electric Company of Fairfield, Conn. The LOCOTROL® system comprises a radio frequency link (channel) and receiving and transmitting equipment at the lead locomotive and the remote locomotives.

FIG. 1 schematically illustrates an exemplary radio-based distributed power railroad train 8 traveling in a direction indicated by an arrowhead 11. One or more remote locomotives 12A and 12B (also referred to as remote units) are controlled from either a lead locomotive 14 or from a control tower 16. Dispatcher-generated commands are issued directly to the remote locomotives 12A and 12B from the control tower 16. Operator-generated commands are issued to the remote locomotives 12A and 12B from the lead locomotive 14. A trailing locomotive 15 mechanically coupled to the lead locomotive 14 is controlled by the lead locomotive 14 via control signals carried on an MU line 17 (an interconnecting plurality of wires) connecting the two locomotives.

Each of the locomotives 14, 12A, and 12B and the control tower 16 are equipped with a transceiver 28 and an antenna 29 for receiving and transmitting the distributed power (DP) communication signals (e.g., commands, replies, status messages, and emergency messages) over a DP communications channel 10. The DP messages are typically generated in a lead locomotive controller 30 in response to operator control of the motive power and braking controls in the lead locomotive 14. The transceiver 28 (in the lead locomotive) transmits the DP messages to control the remote locomotives 12A and 12B and receives incoming signals from the remote locomotives 12A and 12B.

Each of the remote locomotives 12A and 12B includes a controller 32 responsive to DP messages from the lead locomotive 14. The controller 32 executes or replies to the DP messages and also initiates transmission of messages to the lead locomotive 14 to advise of status and alarm conditions.

The distributed power train 8 further comprises a plurality of railcars 20 interposed between the locomotives as illustrated in FIG. 1. The railcars 20 are provided with an air brake system for applying the railcar air brakes in response to a pressure drop in a brake pipe 22 and for releasing the air brakes upon a pressure rise in the brake pipe 22. The brake pipe 22 runs the length of the train for conveying the air pressure changes that are initiated by individual air brake controllers 24 in the locomotives 14, 12A, and 12B. For example, if the lead locomotive 14 issues a DP message to make a service brake application, each of the locomotives 12A and 12B receives the DP message and each associated air brake controller 24 vents the brake pipe 22 to apply the brakes according to a service brake application.

To further improve system reliability, one embodiment of a distributed power train communications system comprises an off-board repeater 26 for receiving messages sent from the lead locomotive 14 and repeating (retransmitting) the messages for receiving by the remote locomotives 12A and 12B. This embodiment may be practiced along a length of track that passes through a tunnel, for example. In such an embodiment the off-board repeater 26 comprises an antenna 35 (e.g., a leaky coaxial cable mounted inside the tunnel) and a remote station 37 for receiving and retransmitting lead and remote locomotive messages.

According to one embodiment, the presently described inventive subject matter provides automatic front and back group control based on the terrain, axle load, or other operating parameters or operating conditions, thereby providing safer and more efficient train operation. Thus, according to a first embodiment (referred to as front group/back group automatic control), the presently described inventive subject matter comprises a distributed power control and communications system that automatically determines front group and back group traction and dynamic braking actions. All locomotives of the front group are automatically controlled to a specified traction or dynamic braking action or operation (collectively referred to as a control aspect of the front group of locomotives) and all locomotives of the back group are automatically controlled to a specified traction or dynamic braking action or operation (collectively referred to as a control aspect of the back group of locomotives, which is likely different than the control aspect of the front group). Thus, each locomotive in the train is controlled according to its assignment to either the front group or the back group.

The application of a control aspect (comprising the application or release of traction or dynamic braking) is determined according to a lookup table, an algorithm, and/or an equation, instead of the current approach in which the operator manually commands traction or dynamic braking notches based on his experience and knowledge. For example, the lookup table, algorithm, and/or equation may specify traction or dynamic braking based on the track gradient (an upgrade or downgrade, for example) or based on different axle loads experienced by the front group and the back group. The table, equation, and/or algorithm may also specify the amount of tractive effort to be applied according to a traction notch number or a percentage of the available tractive effort, or the amount of dynamic braking effort to be applied according to a dynamic braking notch number or a percentage of the available dynamic braking effort.

For example, in one possible lookup table, tabular columns set forth different values of axle load and the tabular rows set forth different values of track gradient; a value at the intersection of the applicable axle load column and the gradient row sets forth the desired amount of traction or dynamic braking. Thus, each locomotive group applies traction or dynamic braking according to one or more operating parameters (e.g., axle load and track gradient), used as indices into a table or used as parameters in the equation/algorithm, that are specific to the locomotive group of interest. Other operating parameters, including the present geographical location of the locomotive (from which the current track gradient can be determined), can also be used to determine the amount of tractive effort or dynamic braking to be applied.

Figure 2:
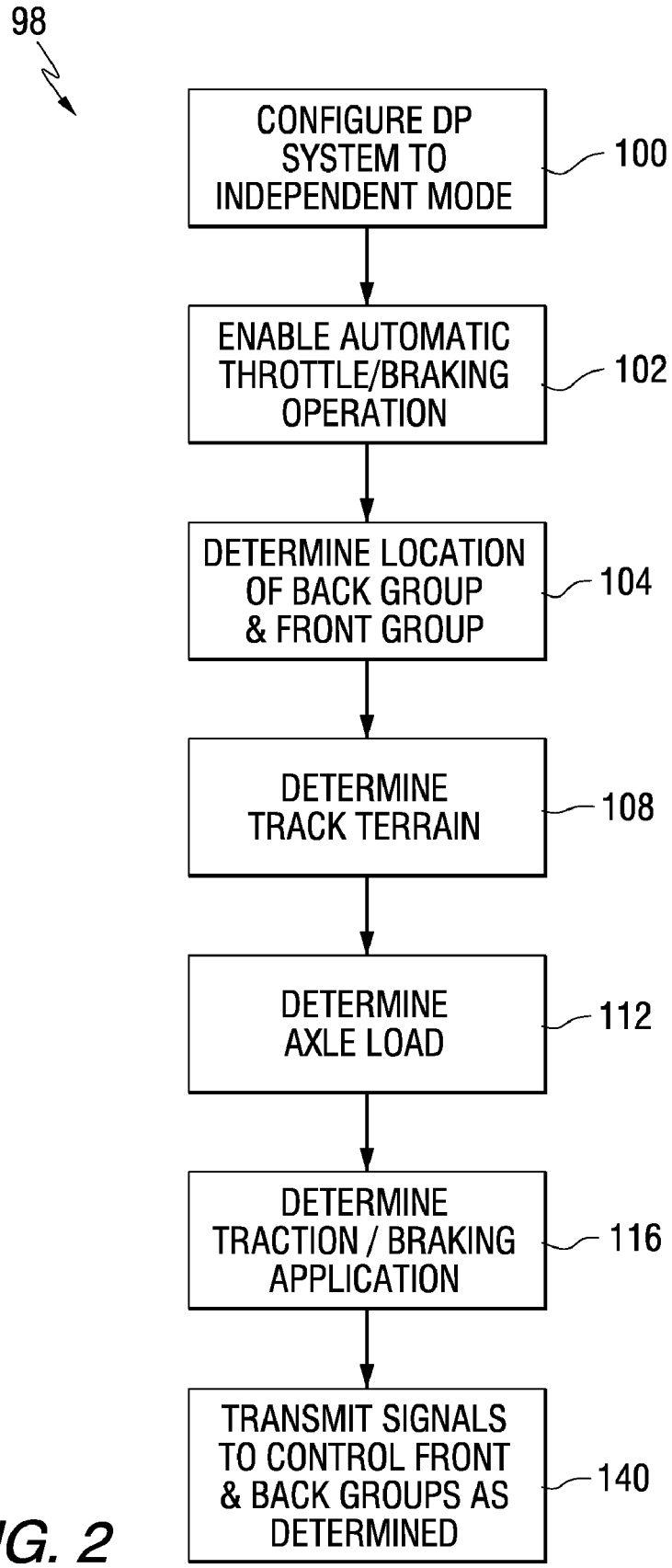
FIG. 2 is a flow chart depicting operation of a front group/back group control mode of an embodiment of the presently described inventive subject matter.

FIG. 2 illustrates a flow chart 98 depicting automatic front and back group control according to one embodiment of the presently described inventive subject matter. At a step 100, the lead locomotive operator elects to configure the DP system to independent mode by transmitting an appropriate signal from the lead locomotive 14 to each of the remote locomotives 12A and 12B over the DP communications channel 10. It is assumed that remote locomotive 12A is assigned to the front group (with the lead locomotive 14) and the remote locomotive 12B is assigned to the back group.

Whenever the train (or the DP system) is configured for independent control operation, the operator in the lead locomotive can further command or enable automatic throttle/braking control. See step 102. In this operational mode, the front and the back group of locomotives are automatically controlled to a determined traction or braking operation (e.g., a control aspect) according to the terrain, axle load, or other operating parameters or operating conditions. If the operator does not invoke the automatic throttle/braking control mode at the step 102, the system operates in the independent control mode in which the operator manually controls the front group and back group by entering traction or braking commands for each group.

At a step 104, a location of the front group and a location the back group are determined along the route of travel. The specific location of the front group (and the back group) can be defined as the location of the first locomotive of the front group (and the location of the first locomotive of the back group), the location of the last locomotive of the front group (and the location of the last locomotive of the back group), or a combination (e.g., average) of the two determined locations for each of the front group and the back group.

The location can be determined by knowing the starting point, the train speed (for example, the average speed) to the current location, and the time elapsed from beginning of the starting point to arrival at the current location. Multiplying the average speed and the elapsed time (in other words, determining a product of the average speed and the elapsed time) yields the distance from the starting point and thus the current track position.

Figure 3:
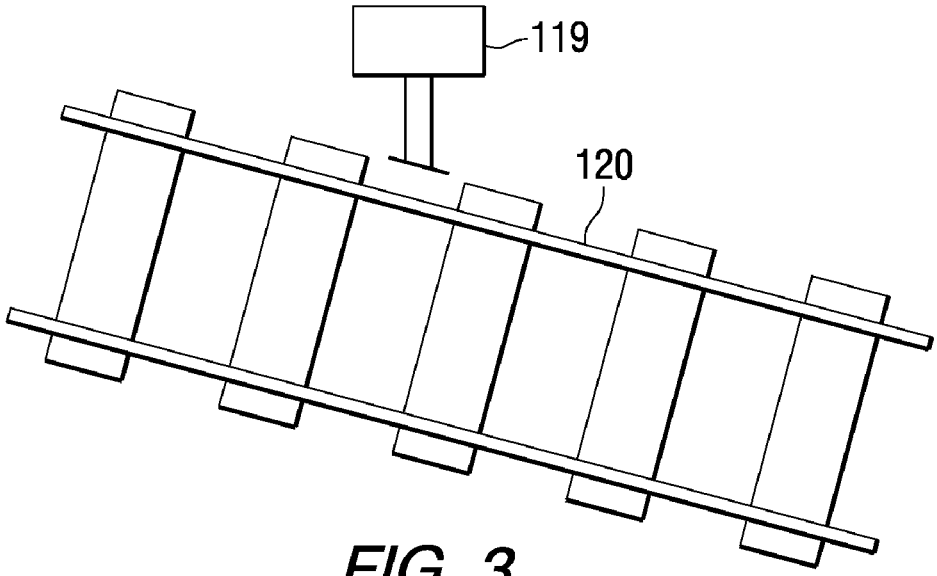
FIG. 3 depicts a wayside location determination device for use with the embodiments of the presently described inventive subject matter.

In another embodiment, a location determining device 114 (see FIG. 1) on each locomotive communicates with a trackside communication unit 119 (see FIG. 3), such as a wayside transmitter or transponder that transmits boundary or location identifying signals to locomotives operating over a track 120. The location determining device 114 on the locomotive receives the transmitted signals, from which its location can be determined, e.g., an absolute location or a location relative to a boundary of an operating area. The unit 119 may include a barcode reader or a wireless communication device, such as an AEI (Automated Equipment Identification) RF tag reader, either of which can provide location information.

In yet other embodiments, the location determination step may be executed by any device that can determine a location of the train locomotives. The location of the locomotives may be a specific location such as a longitude and latitude or may be a position or placement relative to a boundary or position on a track segment. In one embodiment, a global positioning system (GPS) receiver and related equipment may be used.

Once the front group location and the back group location are determined, a track terrain database (either onboard or accessible from the locomotive) is consulted at a step 108 to determine the respective track terrain (e.g., the track gradient) at the current location of the front group and the current location of the back group. The track gradient values may be expressed as negative values representing a downhill gradient and positive values representing an uphill gradient.

It is also possible to determine the axle load borne by the front group and the back group at a step 112. The loads can be determined during initial train set-up based on the weight of the locomotives plus the weight of the railcars (either loaded or unloaded). As described below, the axle loads can also be measured during train operation.

Using the determined values of track gradient and the axle load, a two-dimensional lookup table is consulted at a step 116. The table indicates various axle load values in rows and various gradient values (both negative and positive gradients) in columns. The axle load values are typically a range of axle loads to be expected in the rail system in question. The gradient values are typically a range of gradient values to be expected along the set of tracks in question, or in a rail system generally. A table entry at the intersection of a row and a column sets forth the desired locomotive control parameter or control aspect. The tabular parameter comprises the amount of either tractive or dynamic braking effort to be applied, either as a notch number or as a percentage. Such tables can be constructed for different locomotive models according to the operating parameters of the locomotive. One or more equations or algorithms can be used in lieu of the table to determine the locomotive control parameter or control aspect. Such an equation or algorithm, when executed by a controller/processor, takes a track gradient (or a location that is used to determine a track gradient) and an axle load as inputs, and outputs a tractive or dynamic braking effort. Thus, each equation/algorithm correlates a plurality of track gradients, axles loads, and/or other operating conditions or operating parameters as inputs to a plurality of respective control aspects (tractive effort or braking effort) as outputs:

$$\text{Control aspect}_i = f(\text{operating conditions}_i)$$

where "i" represents a particular locomotive and a function "f" represents the equation or algorithm.

Figure 4:
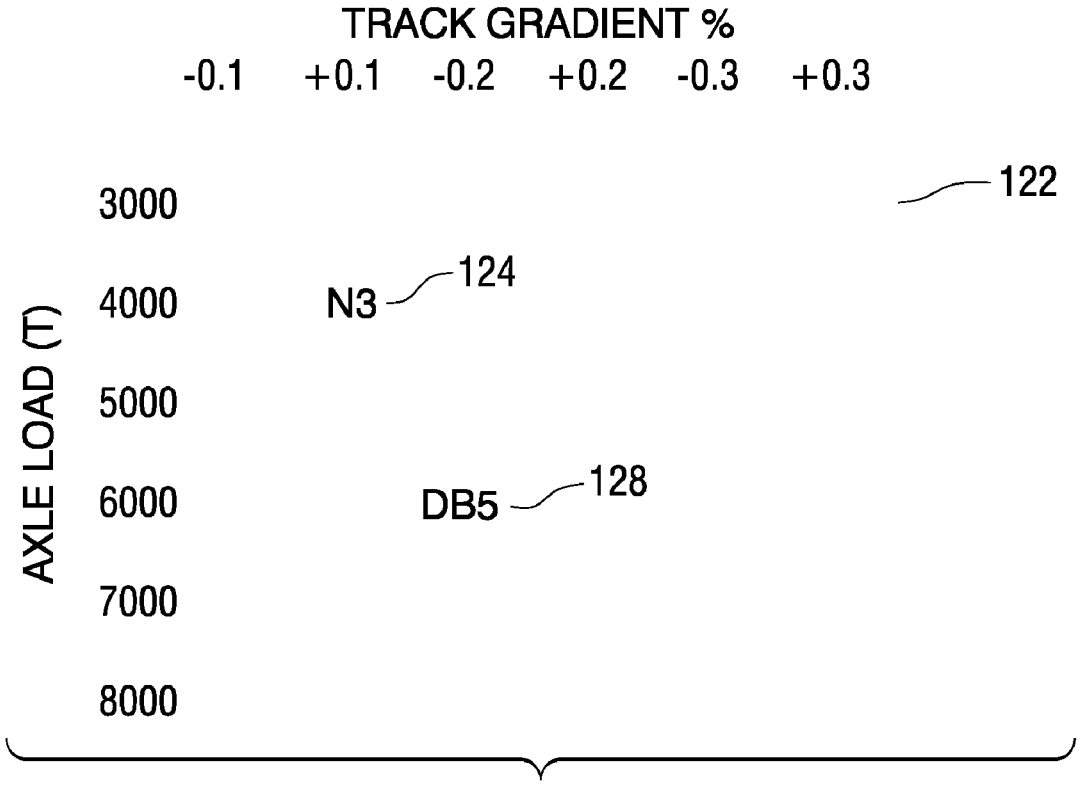
FIG. 4 is a table for use with an automatic-independent operational mode of one embodiment of the presently described inventive subject matter.

FIG. 4 illustrates a table 122 setting forth exemplary axle load values (in tons (T)) in rows and positive and negative track gradient values (expressed as a percentage of track elevation increase/decrease over track horizontal length) in columns. The value at the intersection of any row and column, such as a value identified by a reference character 124, indicates that a notch 3 throttle setting should be applied to the locomotive experiencing a +0.1 track gradient and a 4000-ton (3629 metric tons) axle load. A tabular value referred to by a reference character 128 indicates that a dynamic braking setting of 5 (DB5) should be employed when the locomotive is traveling down a −0.2% grade with an axle load of 6000 tons (5443 metric tons). Higher dimensional tables, or an equation or algorithm, may take into account other track and train operating conditions, such as, for example, track curvature, different locomotive types in the front and back group, allowed locomotive emissions, and locomotive fuel consumption, to determine the amount of tractive effort or dynamic braking effort to apply. The table, algorithm, and/or equation may also incorporate train-handling rules, such as, but not limited to, maximum tractive effort ramp rates and maximum dynamic braking ramp rates.

Returning to the FIG. 2 flowchart, at a step 140, a respective message/signal is transmitted to each of the front group locomotives and the back group locomotives or the lead consist locomotive in any locomotive consist) to control the train locomotives according to the determined throttle/dynamic braking notches or values.

In one alternative to the front group/back group control modes described above, the back group locomotives are further subdivided into back subgroups. For a subgroup comprising a single locomotive, the locomotive is independently controlled. For a subgroup comprising a plurality of locomotives, all the locomotives are identically controlled. The control of the front group and each of the back subgroups, can be initiated manually by an operator in the lead locomotive or automatically, based on, for example, track gradient and axle load as described above.

The above-descried embodiments do not permit independent control of each train locomotive since all locomotives are assigned to either one of the two groups (e.g., a front group and a back group) or to the front group and one of the back subgroups. In any case, all locomotives in each group/subgroup are identically controlled. However, another embodiment of the presently described inventive subject matter obviates the requirement to apply the same tractive effort or dynamic braking effort to all front group locomotives and the same tractive effort or dynamic braking effort to all back group locomotives (or all locomotives of each back subgroup). This embodiment offers the train operator more granular control of the train locomotives and, to reduce the operator's operational burdens, controls each locomotive automatically according to operating conditions or parameters being experienced by the locomotive and/or by the train. It is not required that all remote locomotives are operated in the automatic control mode. Instead, the operator in the lead locomotive may retain control over any remote locomotives and issue operating commands to those locomotives. Additionally, all locomotives in the front group are controlled directly by the operator, albeit the front group may comprise only the lead locomotive of the train.

According to this embodiment, (referred to as an automatic independent-control operational mode) a distributed power control and communications system permits independent control of traction and dynamic braking actions for one or more of the locomotives in the train (thus referred to as "independent" control). This feature is enabled by a command issued by the lead locomotive operator and carried over the DP communications system or over an interconnecting conductor. This mode may be useful if an operator is not present in each remote locomotive to command throttle and dynamic braking actions at that locomotive or for operation over a constantly varying terrain, in the latter situation, the train may be stretched over an undulating terrain with each locomotive experiencing a different uphill or downhill gradient. The features of this embodiment may be especially valuable as the distributed power train traverses such a varying terrain.

Without an operator in each remote locomotive, manual and independent control of each locomotive (by the operator in the lead locomotive) significantly complicates the operator's operating burden. For each locomotive in the train, the operator must determine when to initiate traction/braking actions, when to terminate traction/braking actions, and the extent of the traction or braking action. Each of these actions requires some knowledge of the location of each locomotive along the track system. Otherwise the operator is left to guess the location of each locomotive relative to track gradients, curves, crossings, etc. With many variables and indeterminable parameters to consider, the operator may be unable to properly and safely control the individual locomotives and thus the train, especially for long trains with several remote locomotives. Thus, this embodiment may include automatic control of each locomotive and is therefore referred to as an automatic independent-control operational mode. Obviously, lead locomotive operator control of each remote locomotive is more difficult than in the embodiment described above wherein the train is configured into front and back group locomotives. Independent control of each locomotive improves train performance and handling at the expense of operational complexity. Thus automatic independent control of each remote locomotive may be desired.

Further, automatic independent control of each locomotive (e.g., control according to the terrain being traversed and/or other external conditions) offers cost savings and eliminates dependency on the skill of the operator in controlling the DP train. While it may be possible for an operator to develop the requisite skill, perhaps by frequently operating the same train configuration over the same track segment, this experience is not easily transferable to a different configuration of remote locomotives and railcars over a different terrain. The present embodiment eliminates reliance on the skill level of the operator, relieves the operator of some operating burdens, and provides safe and efficient train operation.

Timing (e.g., initiation and removal of traction action and dynamic braking action may be independently controlled for each locomotive responsive to operating conditions, such as a rail gradient of the rails on which the train is traveling, condition of the rails, terrain, time of day, speed restriction (as posted for a specific rail segment or according to a condition of the train locomotives), emissions, fuel consumption, weather conditions, axle load, or any other parameters that affect operation of the railroad train. The magnitude of the traction or dynamic braking action (e.g., a percent of traction or dynamic braking or a traction or a dynamic braking notch number) is also independently controllable for each train locomotive (or according to another embodiment for each locomotive subgroup, each subgroup comprising at least one locomotive).

The automatic independent-control operational mode may be disabled when the train is on level terrain and it is desired to identically control all locomotives according to conventional DP synchronous control mode. The automatic independent-control operational mode may be later activated as the train approaches an upward or downward track gradient, for example. The system can be enabled or disabled by operator issuance of a command (carried over the DP communications system or over an interconnecting wire) from the lead locomotive to each remote locomotive. When the automatic independent-control mode is disabled, each locomotive in the DP train reverts to lead operator initiated commands according to conventional DP operations, e.g., synchronous operation or back group/front group operation based on operator-initiated commands. When in front/back group operation the operator can issue separate control commands for the front group and the back group based on his operating experiences (a conventional DP control system) or the front and back groups can be automatically controlled according to the embodiment described above.

Figure 5:
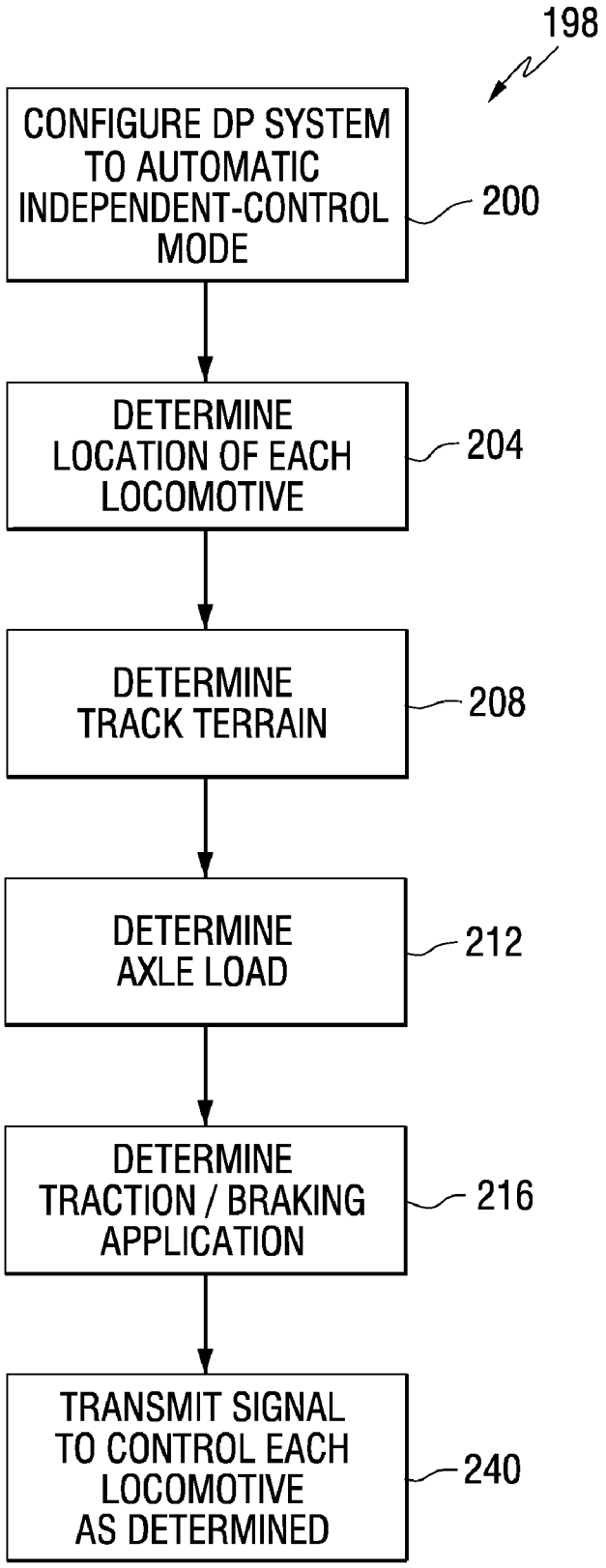
FIG. 5 is a flow chart depicting operation in the automatic-independent mode.

FIG. 5 illustrates a flow chart 198 depicting the automatic independent-control operational mode for a railroad train. At a step 200, the lead locomotive operator configures the DP system to an automatic independent-control mode by transmitting an appropriate signal from the lead locomotive 14 (see FIG. 1) to one or more of the remote locomotives 12A and 12B over the DP communications channel 10. For locomotive consists (e.g., at least two locomotives coupled together with the lead consist locomotive controlling the trailing consist locomotive(s) by signals carried over the MU lines) it may be necessary to apply the concepts of this embodiment to only the lead consist locomotive in each locomotive consist, since the trailing consist locomotives are controlled by the lead consist locomotive.

At a step 204, each locomotive of the train determines its current location along the route of travel. This can be accomplished according to any of the techniques described above, e.g., GPS receivers. Location determination is performed for each locomotive in the train (and/or for each locomotive serving as the locomotive consist leader in the case of two or more locomotives joined by an MU line), especially since today's trains are typically long and the location of each locomotive may be significantly different relative to the track terrain, curvature, etc.

Once the location of each locomotive is determined, a track terrain database (either onboard or accessible from the locomotive) is consulted at a step 208 to determine the track terrain (e.g., the track gradient) at the current location of each locomotive. The track gradient values may be expressed as negative values representing a downhill gradient and positive values representing an uphill gradient, or by traction applications for uphill gradients and dynamic braking applications for downhill grades. In the exemplary illustration the axle load borne by each locomotive is also determined at a step 212. Using the determined values of track gradient and the axle load, the table 122 of FIG. 4 (or an algorithm or equation) is consulted at a step 216. The tabular parameter (or algorithm or equation result) comprises the amount of either tractive or dynamic braking effort to be applied by the locomotive in question. Other operating conditions of the train can be used in lieu of the track gradient and the axle load.

A train may include several different locomotive types each with different operating characteristics and limitations. Thus, it may be necessary to create a different look-up table (or equation or algorithm) for each different locomotive type to reflect these different operating parameters. The look-up table may also be a function of the train make-up and configuration.

Returning to the FIG. 5 flowchart 198, at a step 240, a control signal is transmitted (in one embodiment over the DP communications system) to each locomotive in the automatic independent control mode to automatically control the locomotive according to the determined throttle/dynamic braking value. Thus, according to this embodiment of the inventive subject matter, each locomotive operating in this mode in the DP train will self-control by determining its location along the track (from which the terrain at that location is determined), determining its axle load, and consulting the look-up table (and/or an equation or algorithm). The locomotive control system then applies the determined amount of dynamic braking or traction. Other locomotive characteristics and train and terrain or rail operating parameters can be used to determine the locomotive control operations, e.g., traction or dynamic brake applications and the magnitude of such applications.

Although independent control of each locomotive may appear to obviate the need for a fully-functional DP communications and control system (except to initially configure the remote locomotives to automatic independent-control operation), in fact such a system may be required to permit the operator in the lead locomotive to monitor the status of the remote locomotives. Further, operation in the conventional synchronous and conventional front group/back group modes requires a fully-functional DP system. Also, the DP communications system is required for certain common train-wide commands (e.g., issued to all train locomotives), such as direction control, manual release of sand to increase rail traction, etc.

In yet another embodiment, the inventive subject matter embodies automatic control of the distributed power train as it traverses a crest of a hill (e.g., automatic crest control). Such a system increases train safety, reduces the likelihood of train breaks, provides better and safer train handling, and reduces the risk of loosing control of the train as it crests a hill.

In this embodiment control is exercised according to drawbar force measured at the front and rear of each remote locomotive consist, the acceleration (or deceleration), and the speed of the locomotive consist. It is recognized that there are no front drawbar forces exerted on the lead locomotive and no rear drawbar forces exerted on a locomotive at an end of train position (sometimes referred to as a pusher locomotive). Control logic according to this embodiment is therefore based primarily on the front and rear drawbar forces exerted on a remote locomotive (or a remote locomotive consist) that experiences both front and rear drawbar forces. A remote locomotive consist may comprise one or more locomotives and a railroad train may comprise more than one remote locomotive consist. Generally, a controlling locomotive comprises an independent locomotive or a locomotive controlling other locomotives in the same locomotive consist.

Figure 6:
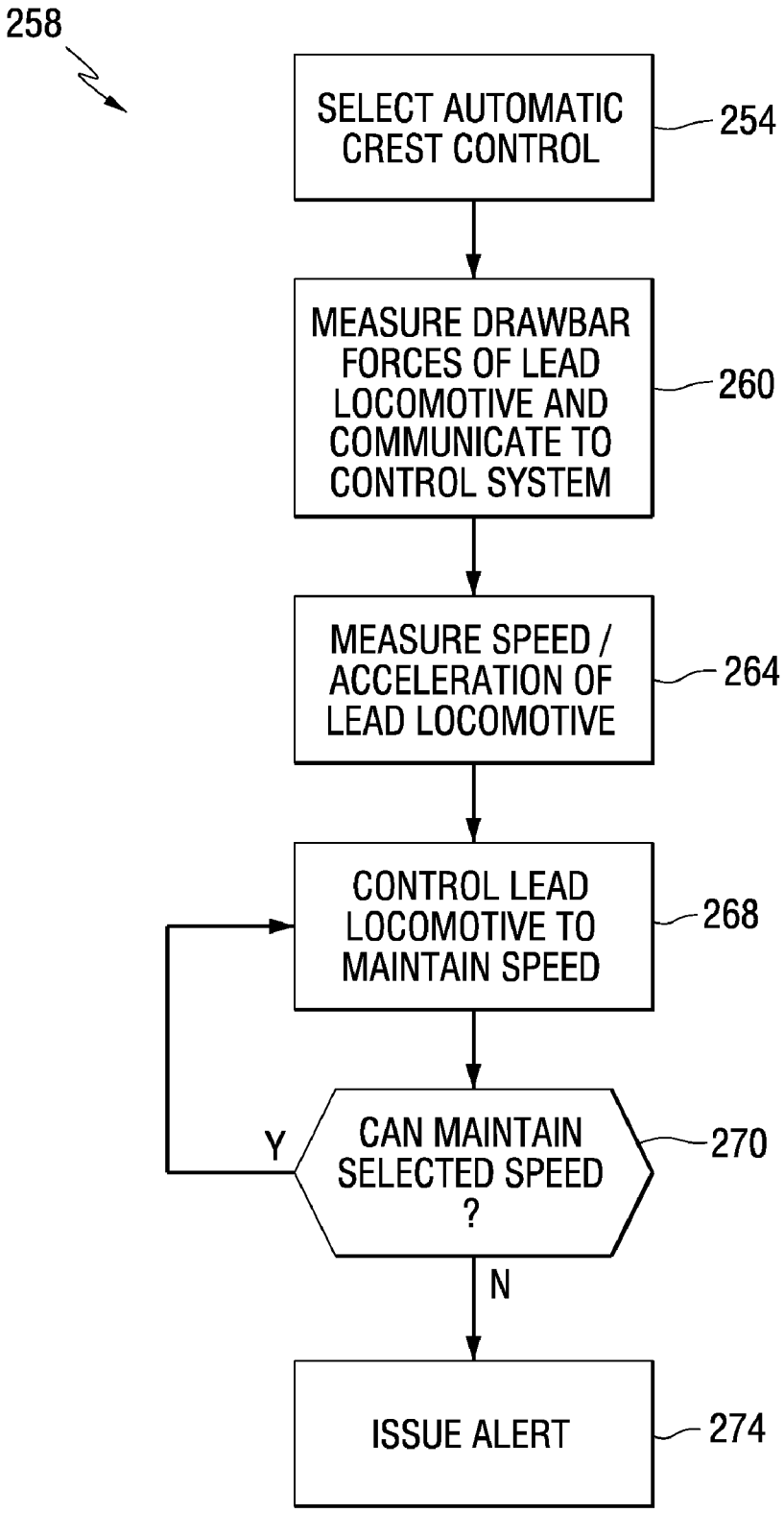
FIG. 6 is a flow chart depicting operation of an automatic crest control feature of one embodiment of the presently described inventive subject matter.

FIG. 6 is a schematic representation of the railcars 20 and the remote locomotive 12A (in this configuration the remote locomotive 12A is a controlling locomotive). The railcars 20 and the remote locomotive 12A each have a front coupler 148 and a rear coupler 149 for engaging a respective rear coupler 149 and a front coupler 148 disposed on an adjacent railcar or locomotive. A drawbar is a solid coupling between a locomotive and its hauled load (e.g., railcar). An example locomotive drawbar and an example measurement device for measuring linear force on a locomotive drawbar are shown in U.S. Pat. No. 4,838,173 dated Jun. 13, 1989, incorporated by reference herein in its entirety. The use of other measurement devices is possible.

A measurement device 150 measures the linear force (drawbar force) exerted on the front drawbar 154 of the locomotive 12A. Similarly, a measurement device 152 measures the linear force exerted on the rear drawbar 156 of the locomotive 12A. The drawbar force measurements are communicated to an automatic control system described below.

The automatic crest control feature of this embodiment can be incorporated into the automatic control functions of a DP train as described herein (e.g., automatic control of the front group and back group locomotives (or the back subgroups locomotives) or automatic independent control each locomotive of the train). This embodiment can also serve as a control mechanism for a DP train without a DP communications channel.

As the DP train approaches or encounters a hill crest, according to the teachings of this embodiment, the operator selects "Automatic Crest Control" for a similar designation for initiating operation of the automatic crest control feature) and selects the maximum desired downhill speed. Typically the train speed is defined as the speed of the lead locomotive, but can also be defined as the speed of any locomotive of the train, the speed of any railcar for which the speed can be determined, or any combination thereof. While the train is operating in automatic crest control mode, an manual operator control actions (e.g., the manual application of throttle or braking commands) override the automatic control system.

An example of the automatic crest control feature is now described. Assume a long train with a lead locomotive and a mid-train remote locomotive traverses an uphill grade of a large hill. As the mid-train remote locomotive travels uphill, the locomotive pushes the forward railcars (e.g., the railcars in front of and proximate the mid-train locomotive), causing these railcars to compress or bunch. The condition of the forward railcars beyond a proximate region of the mid-train locomotive tends to be determined by the control exercised by the lead locomotive; generally these railcars are stretched as the train travels uphill. The mid-train locomotive pulls and stretches the rearward railcars (e.g., the railcars from the mid-train locomotive to the end of the train).

The resulting force on the front drawbar of the mid-train locomotive is in a direction toward the mid-train locomotive and the force magnitude is determined by the number of cars that are in the compressed condition (which is further determined by the number of cars between the mid-train locomotive and the lead locomotive and the tractive or braking effort exerted by the lead locomotive). The force on the rear drawbar is in a direction away from the mid-train locomotive, exerted by the stretched railcars, and the magnitude is determined by the number and weight of the rearward railcars and the grade of the hill.

As each forward railcar crests the hill it is no longer being pushed by the mid-train remote locomotive. The front drawbar force decreases and passes through zero. The forward railcars that have crested the hill start to stretch, with the amount of stretch determined by the number of forward railcars that have crested the hill, the number of forward railcars between the mid-train locomotive and the lead locomotive and the tractive or braking force exerted by the lead locomotive. At this point, the automatic crest control system will begin to throttle down and/or apply dynamic brakes on the lead locomotive to control/minimize train acceleration.

As the mid-train locomotive continues to climb the hill, it pulls the rearward railcars and they remain in a stretched condition. But as the mid-train locomotive accelerates to reach the crest, the entire train accelerates and the mid-train locomotive exerts a greater force on the rearward railcars. The rear drawbar force increases and continues to point away from the mid-train locomotive. The drawbar pull force while a locomotive is accelerating is higher than the drawbar pull force while the locomotive is maintaining a constant speed for a given grade.

After cresting the hill, the mid-train remote locomotive is pulled by the forward railcars. The pulling force of the forward railcars causes the front drawbar force to now point away from the mid-train locomotive, with the magnitude determined by the number of railcars between the lead and the mid-train locomotives and also the traction or braking actions of the lead locomotive.

The rear drawbar force continues to point away from the mid-train locomotive as the rearward railcars are stretched. But as rearward railcars crest the hill, they begin to compress or bunch and push the mid-train locomotive. After a sufficient number of rearward railcars have crested the hill the force on the rear drawbar transiently passes through zero, reverses direction and now points toward the mid-train locomotive. Once the mid-train locomotive crests the hill, the automatic crest control system begins to throttle down or apply the dynamic brakes on the mid-train remote locomotive.

As the mid-train locomotive continues on the downhill slope, the proximate forward railcars tend toward a stretched condition and begin to pull on the mid-train locomotive. The front drawbar force continues to point away from the mid-train locomotive and increases in magnitude as determined by the number of railcars between the lead and mid-train locomotives and the force exerted by the lead locomotive.

Thus as can now be appreciated, the rear drawbar force on the mid-train locomotive changes direction after the mid-train locomotive and a sufficient number of rearward railcars have crested the hill. As the mid-train locomotive is traversing the uphill gradient, the force is represented by a first vector quantity having a magnitude and a first direction (away from the mid-train locomotive). The magnitude decreases as the mid-train remote locomotive approaches the crest and changes to a second direction (pointing toward the mid-train locomotive) after the mid-train locomotive and a sufficient number of rearward railcars have passed over the crest.

The front drawbar force is represented by a third vector quantity (pointing toward the mid-train locomotive) as the mid-train locomotive climbs the hill and decreases in magnitude as the mid-train remote locomotive reaches the crest. The force is represented by a fourth vector quantity as the force changes direction after the mid-train locomotive passes the crest.

The system of this embodiment detects when the mid-train remote locomotive (and the lead locomotive) has crested the hill based on changes in the direction of the drawbar forces. The speed and the acceleration of the lead locomotive and the mid-train remote locomotive can be determined based on the hill gradient, the weight distribution of the railcars and the application of dynamic brake or tractions actions.

An analysis may be performed to determine typical drawbar forces for the lead and the remote locomotives based on the gradient, distribution and weight of the railcars and the characteristics of the lead and mid-train remote locomotives. The actual forces will be compared against these typical drawbar forces to determine when locomotives are traveling uphill or downhill and when they have crested the hill.

Figure 7:
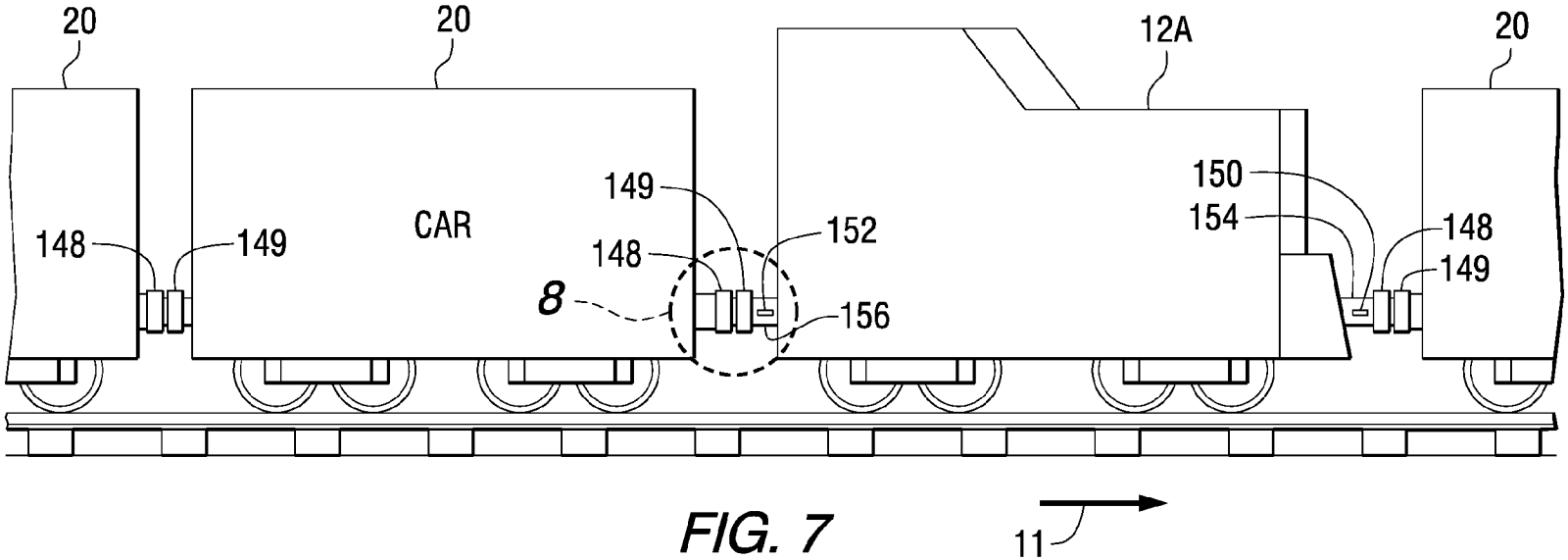
FIG. 7 is a schematic representation of a train segment illustrating drawbar force measuring elements.
Figure 8:
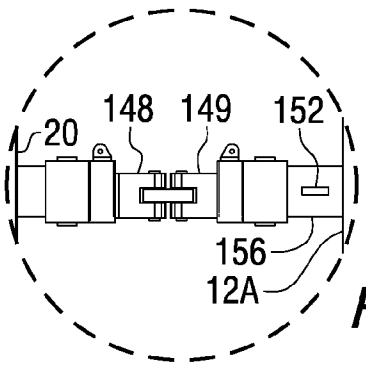
FIG. 8 is a detailed view of the coupling region of FIG. 7.

A flowchart 258 of FIG. 7 illustrates the automatic crest control embodiment of the presently described inventive subject matter. At a step 254, an operator selects the automatic crest control feature. At a step 260, the drawbar forces are measured as described above and communicated to a locomotive control system.

At a step 264, the speed and/or acceleration of the controlling locomotive is determined. At a step 268, the system controls the controlling locomotive as necessary to control the acceleration and/or speed to maintain the train speed at or below a pre-selected value.

In one embodiment, both the front and rear drawbar forces are detected to determine when a locomotive crests a hill. See the step 260. In another embodiment, it may be required to determine only one of the drawbar forces and infer the other drawbar force from the measured acceleration or speed data. The drawbar force at the front coupler of the lead locomotive is zero since no railcars are coupled to the front coupler and the drawbar force at the rear drawbar of an end-of-train locomotive is also zero.

The railroad system owner/operator can perform tests to determine how a train may respond (e.g., the expected front and rear drawbar forces) as a specifically configured train (e.g., railcar weight distributions, number of railcars between consecutive locomotives) traverses a specific hill crest (e.g., a specific hill gradient). The expected train response, used in conjunction with actual measured acceleration data, may determine when it is desired to begin throttling down each locomotive and also when to start applying dynamic brake for each locomotive.

The automatic crest control system can also provide an alert indication to the operator when the acceleration or speed exceeds the control capability of the automatic control system. At a decision step 270 of the flowchart 258, a determination is made whether the system can maintain the selected speed. If the system is able to maintain that speed, processing returns to the control step 268. If the system is unable to maintain that speed, an alert is issued at a step 274. The alert prompts the operator for additional action apply train air brakes). According to another embodiment, the system automatically applies the train air brakes in lieu of or in addition to activating the operator alert.

According to yet another embodiment, consist data (comprising, for example, the number of railcars between the lead locomotive and the remote locomotives) entered into the system allows the calculation of the distance between the lead locomotives and the remote locomotives. When the lead locomotive has crested over the hill, a distance counter can determine when the first remote locomotive reaches the crest.

Knowing when each remote locomotive crests the hill assists with speed control. Alternatively, a GPS unit onboard each locomotive determines the location of each locomotive relative to the crest and a train control algorithm controls each locomotive according to that location.

According to still another embodiment applicable to a DP system configured for front group/back group control, the drawbar forces are monitored and the system adjusts the throttle and dynamic brakes of the front group and the back group locomotives to safely and efficiently control the speed of the train as each locomotive crests the hill. Specifically, changes in the drawbar forces at each remote locomotive identify when a remote locomotive has crested the hill. The system then automatically "moves the fence" to move that locomotive from the back group into the front group. The system also controls the throttle and dynamic brakes of both the front group and back group locomotives to control train speed.

In addition to using the measured drawbar forces to control the train as described above, the collected data can be used to analyze drawbar forces in various train configurations. These measurements allow better train modeling and optimization of recommended train configurations.

According to yet another embodiment, a train can be controlled at it traverses a hill using a map of the train's route and real-time train location information (from a GPS unit installed in the lead locomotive or from a wayside sensor or transponder). Each section of track on the route is associated with a throttle and/or dynamic brake setting or a train speed control algorithm for each locomotive traversing the specific track segment. In the latter case, the algorithm uses train consist information (weight of each railcar, distance between locomotives, etc.) to determine the desired train speed.

Although certain of the aforementioned embodiments include determining locomotive location, this is not a requirement. For example, track gradient can be determined directly from sensors onboard a locomotive, such as an inclination sensor, electrolytic tilt sensor, gyroscope-based devices, or the like. Such sensors are available from, for example, Advanced Orientation Systems, Inc. of Linden, N.J.

Another embodiment relates to a method for controlling a train. The method comprises automatically controlling a first locomotive group in the train according to a first control aspect (e.g., traction or braking action). The first locomotive group comprises one or more locomotives. The first control aspect is based on one or more operating conditions associated with the first locomotive group, such as track gradient and axle load. The method further comprises controlling a second locomotive group in the train according to a second control aspect. The second control aspect is different than the first control aspect, and is based on one or more operating conditions associated with the second locomotive group. The second locomotive group is remote from the first locomotive group, meaning at least one railcar separates the second group from the first group. In another embodiment, the second locomotive group is distinct from the first group, and thereby comprises one or more locomotives in the train that are not part of the first locomotive group. In still another embodiment, the respective control aspects are determined by applying the respective operating conditions to a lookup table, formula or algorithm.

One element of the various presented embodiments comprises safety interlocks that prevent train mishaps and accidents during operation in the various DP modes. When train control (or lack of appropriate train control) violates a train operating condition (referred to as a safety interlock condition) operational interlocks automatically command the train to a safe operating condition. For example, in the event of a loss of radio communications between the lead and the remote locomotives or in the event of a failure to execute a commanded operation (where the failure is determined according to the status reply message from a remote locomotive), the DP system places the locomotives into a safety throttle condition, such as throttle idle mode, until the condition is corrected. Also, interlocks prevent (and alarms announce) potentially dangerous incipient conditions, that, for example, may cause the train to be pulled apart.

Throughout the description, the various referenced locomotives have been described as a single locomotives, e.g., not coupled to another locomotive but instead coupled only to railcars. However, the teachings of the various embodiments are also applicable to locomotive consists (i.e., at least two locomotives coupled together where the lead consist locomotive controls the trailing consist locomotive(s) by signals carried over the MU lines connecting the locomotives). The concepts of the various embodiments may be applied only to the lead locomotive in each locomotive consist, since trailing consist locomotives are controlled by the lead consist locomotive. Also, in a train comprising additional locomotives (e.g., in addition to the lead locomotive 14 and the remote locomotives 12A and 12B), these additional locomotives can be assigned to the front group or to the back group.

Throughout the description, the terms "radio link," "RF link," and "RF communications" and similar terms describe a method of communicating between two links in a network. It should be understood that the communications channel or link between nodes (locomotives) in the system is not limited to radio or RF systems or the like and is meant to cover all techniques by which messages may be delivered from one node to another or to plural others, including without limitation, magnetic systems, acoustic systems, wire-based systems and optical systems. Likewise, the system is described in connection with an embodiment in which radio (RF) links are used between nodes and in which the various components are compatible with such links however, this description of the presently preferred embodiment is not intended to limit the inventive subject matter to that particular embodiment.

The presently described inventive subject matter, when embodied in the flow charts described above, can be embodied in the form of computer-implemented processes and apparatus for practicing those processes and for controlling a railroad train and its constituent locomotives. The presently described inventive subject matter can also be embodied in the form of computer program code comprising computer-readable instructions embodied in tangible media, such as floppy diskettes, CD-ROMs, hard disks, flash drives, or any other computer-readable storage medium. When the computer program code is loaded into and executed by a computer or processor, the computer or processor becomes an apparatus for practicing the inventive subject matter. The presently described inventive subject matter can also be embodied in the form of computer program code (an article of manufacture) for example, whether stored in a storage medium, loaded into and/or executed by a computer, or transmitted over a transmission medium, such as over electrical wiring or cabling, through fiber optics, or via electromagnetic radiation, wherein, when the computer program code is loaded into and executed by a computer or processor, the computer or processor becomes an apparatus for practicing the inventive subject matter. When implemented on a general-purpose computer, the computer program code segments configure the computer to create specific logic circuits or processing modules.

Moreover, one of ordinary skill in the art will appreciate that the embodiments of the inventive subject matter may be practiced with various computer system configurations, including hand-held devices, multiprocessor systems, microprocessor-based or programmable consumer electronic devices, minicomputers, mainframe computers, web-based systems, client/server systems and the like. The inventive subject matter may also be practiced in distributed computing environments where tasks are performed by remote processing devices that are linked by a communications network. In a distributed computing environment, program modules may be located in both local and remote computer storage media, including memory storage devices. These local and remote computing environments may be contained entirely within the controlled locomotive, within a locomotive within the same locomotive consist as the controlled locomotive, within a remote locomotive separated from the controlled locomotive by one or more railcars, or off-board in a wayside device or a central office where wireless communication provides connectivity between the local and remote computing environments.

This written description uses examples to disclose the inventive subject matter, including the best mode, and also to enable any person skilled in the art to practice the inventive subject matter, including making and using any devices or systems and performing any incorporated methods. The patentable scope of the inventive subject matter is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method for controlling a lead locomotive and a remote locomotive of a rail vehicle consist, the lead and the remote locomotives separated by one or more railcars, the method comprising:

determining a first drawbar force exerted on a rear drawbar at a rear end of the lead locomotive to determine when the lead locomotive has crested a hill;

determining a second force exerted on a front drawbar and a third force exerted on a rear drawbar of a mid-consist locomotive of the rail vehicle consist as the mid-consist locomotive traverses the gradient, the mid-consist locomotive separated from the lead locomotive by one or more railcars;

determining at least one of a speed or an acceleration of the lead locomotive subsequent to the lead locomotive cresting the hill;

selecting an upper train speed; and controlling by a controller the lead locomotive to maintain the speed of the lead locomotive below the upper train speed after the lead locomotive has crested the hill, wherein the first force is determined from at least one of a direction or a magnitude of the first force on the rear drawbar of the lead locomotive, the second force is determined from at least one of a direction or a magnitude of the second force on the front drawbar of the mid-consist locomotive, and the third force is determined from at least one of a direction or magnitude of the third force on the rear drawbar of the mid-consist locomotive.

2. The method of claim 1, wherein controlling the lead locomotive further comprises applying brakes on the lead locomotive or throttling down the lead locomotive responsive to a number of the one or more railcars that have crested the hill or to the drawbar force at the rear end of the lead locomotive.

3. The method of claim 1, further comprising determining a respective drawbar force at a front end and a rear end of the remote locomotive, and wherein controlling the lead locomotive further comprises controlling the lead locomotive responsive to the drawbar force at the front end of the remote locomotive and the drawbar force at the rear end of each of the lead locomotive and the remote locomotive.

4. The method of claim 3, further comprising controlling the remote locomotive responsive to the respective drawbar force at the front end and the rear end of the remote locomotive.

5. The method of claim 1, further comprising determining a respective actual drawbar force at a rear end and a front end of the remote locomotive and determining an expected drawbar force at the rear end of the lead locomotive and respective expected drawbar forces at the rear end and the front end of the remote locomotive, the expected drawbar forces responsive to at least one of a determined hill gradient or a configuration of the rail vehicle consist, wherein controlling the lead locomotive is performed responsive to the expected drawbar forces and the actual drawbar forces.

6. The method of claim 1, further comprising activating an alert when controlling the lead locomotive cannot maintain the speed below the upper train speed.

7. The method of claim 1, further comprising determining a respective drawbar force at a front end and a rear end of the remote locomotive to determine when the remote locomotive has crested the hill.

8. The method of claim 1, further comprising using at least one of a global positioning system (GPS) apparatus or a wayside transponder to determine when at least one of the lead locomotive or the remote locomotive has crested the hill.

9. The method of claim 1, further comprising selecting an upper speed, and wherein controlling the lead locomotive and the mid-consist locomotive comprises controlling at least one of the lead locomotive or the mid-consist locomotive to maintain a speed of the lead locomotive at or below the upper speed.

10. A method comprising:

automatically controlling a first locomotive group in a rail vehicle consist according to a first control aspect, the first control aspect based on one or more operating conditions associated with the first locomotive group, wherein the first control aspect includes a first drawbar force exerted on a rear drawbar of a lead locomotive of the first locomotive group; and automatically controlling a second locomotive group in the rail vehicle consist according to a second control aspect, the second control aspect based on one or more operating conditions associated with the second locomotive group, wherein the second locomotive group is remote from the first locomotive group, wherein the second control aspect includes a second force exerted on a front drawbar and a third force exerted on a rear drawbar of a mid-consist locomotive of the second locomotive group, and wherein the first force is determined from at least one of a direction or a magnitude of the first force on the rear drawbar of the lead locomotive, the second force is determined from at least one of a direction or a magnitude of the second force on the front drawbar of the mid-consist locomotive, and the third force is determined from at least one of a direction or a magnitude of the third force on the rear drawbar of the mid-consist locomotive.

11. The method of claim 10, wherein, for each of the first and second locomotive groups, the one or more operating conditions comprises an axle load of an axle of a locomotive in the respective first or second locomotive group, a rail gradient of rails on which the rail vehicle consist is traveling, a terrain over which the rail vehicle consist is traveling, a condition of the rails, a time of day, one or more speed restrictions, fuel consumption of the rail vehicle consist, emissions of the rail vehicle consist, or one or more weather conditions.

12. The method of claim 10, wherein the first and the second control aspects comprise application of traction action or braking action and a magnitude of the traction action or braking action.

13. The method of claim 10, wherein the first control aspect is determined based on a first location of the first locomotive group along a track being traveled by the rail vehicle consist and a first operating condition of one or more locomotives in the first group, and the second control aspect is determined based on a second location of the second group along the track and a second operating condition of one or more locomotives in the second group.

14. The method of claim 10, further comprising:

determining the second control aspect by communicating the first control aspect to the one or more locomotives of the second group for use in determining the second control aspect;

wherein determining the first control aspect includes communicating the second control aspect to the one or more locomotives of the first group for use in determining the first control aspect.

15. The method of claim 14, wherein determining the first control aspect and determining the second control aspect are executed on a lead locomotive of the rail vehicle consist, and further comprising communicating the first control aspect from the lead locomotive to one or more locomotives of the first locomotive group and communicating the second control aspect from the lead locomotive to the one or more locomotives of the second locomotive group.

16. The method of claim 10, wherein the first control aspect is different from the second control aspect.

17. The method of claim 10, wherein at least one of the first operating condition of the first group or the second operating condition of the second group is based on a terrain over which one or more locomotives of the first group travels or over which one or more locomotives of the second group travels.

18. The method of claim 17, wherein the terrain comprises an upgrade or a downgrade and the at least one of the first operating condition or the second operating condition includes an indication of the upgrade or the downgrade.

19. The method of claim 10, wherein at least one of the first operating condition or the second operating condition comprises an axle load of one or more axles of one or more locomotives in the first locomotive group or one or more locomotives in the second group, a rail gradient of one or more rails on which the rail vehicle consist is traveling, a terrain over which the rail vehicle consist is traveling, a condition of the one or more rails, a time of day, a speed restriction, an amount of fuel consumption, an amount of generated emissions, or a weather condition.

20. The method of claim 10, further comprising transmitting a signal from a lead locomotive of the rail vehicle consist to at least one of the first locomotive group or the second locomotive group to initiate at least one of determining the first control aspect or determining the second control aspect.

21. The method of claim 10, wherein the first locomotive group includes a plurality of first locomotives directly coupled with each other in a first locomotive consist and the second locomotive group includes a plurality of second locomotives directly coupled with each other in a second locomotive consist, the method further comprising communicating the first control aspect to the first locomotives of the first locomotive consist through a first interconnecting conductor that extends through the first locomotives and communicating the second control aspect to the second locomotives of the second locomotive consist through a different, second interconnecting conductor that extends through the second locomotives.

* * * * *

UNITED STATES PATENT AND TRADEMARK OFFICE

CERTIFICATE OF CORRECTION

PATENT NO. : 8,406,942 B2
APPLICATION NO. : 13/530436
DATED : March 26, 2013
INVENTOR(S) : Siddappa et al.

It is certified that error appears in the above-identified patent and that said Letters Patent is hereby corrected as shown below:

In the Specification

In Column 10, Line 10, delete “removal” and insert -- removal) --, therefor.

In Column 12, Line 42, delete “for a” and insert -- (or a --, therefor.

In Column 12, Line 49, delete “an manual” and insert -- any manual --, therefor.

In Column 14, Line 57, delete “action apply” and insert -- action (e.g., apply --, therefor.

In Column 16, Line 39, delete “links” and insert -- links; --, therefor.

Signed and Sealed this
Sixth Day of August, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,406,942 B2
APPLICATION NO. : 13/530436
DATED : March 26, 2013
INVENTOR(S) : Siddappa et al.

It is certified that error appears in the above-identified patent and that said Letters Patent is hereby corrected as shown below:

In the Specification

In Column 1, Line 11, delete "2009" and insert -- 2009, --, therefor.

In Column 2, Line 40, delete "control all" and insert -- control, all --, therefor.

In Column 2, Line 62, delete "aback" and insert -- a back --, therefor.

In Column 3, Line 40, delete "group," and insert -- group; --, therefor.

In Column 3, Line 41, delete "from group" and insert -- front group --, therefor.

In Column 8, Line 54, delete "or the" and insert -- (or the --, therefor.

In Column 9, Line 1, delete "above-descried" and insert -- above-described --, therefor.

In Column 9, Line 35, delete "terrain, in" and insert -- terrain. In --, therefor.

In Column 10, Line 10, delete "removal" and insert -- removal) --, therefor.

In Column 12, Line 42, delete "for a" and insert -- (or a --, therefor.

In Column 12, Line 49, delete "an manual" and insert -- any manual --, therefor.

In Column 14, Line 57, delete "action apply" and insert -- action (e.g., apply --, therefor.

In Column 16, Line 39, delete "links" and insert -- links; --, therefor.

This certificate supersedes the Certificate of Correction issued August 6, 2013.

Signed and Sealed this
Twenty-second Day of July, 2014

Michelle K. Lee

Michelle K. Lee
*Deputy Director of the United States Patent and Trademark Office*